US007506411B2

(12) United States Patent
Temburg et al.

(10) Patent No.: US 7,506,411 B2
(45) Date of Patent: Mar. 24, 2009

(54) APPARATUS FOR FEEDING A PLURALITY OF CHARGING SHAFTS, ESPECIALLY A MIXER, WITH FIBRE MATERIAL

(75) Inventors: Konrad Temburg, Mönchengladbach (DE); Jörg Schmitz, Linnich (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 432 days.

(21) Appl. No.: 11/290,580

(22) Filed: Dec. 1, 2005

(65) Prior Publication Data

US 2006/0124667 A1 Jun. 15, 2006

(30) Foreign Application Priority Data

Dec. 14, 2004 (DE) ..... 10 2004 060 403

(51) Int. Cl.
*D01G 13/00* (2006.01)

(52) U.S. Cl. ..... 19/145.5

(58) Field of Classification Search ..... 19/145, 19/145.5

See application file for complete search history.

(56) References Cited

U.S. PATENT DOCUMENTS

| | | | | |
|---|---|---|---|---|
| 3,577,844 A | | 5/1971 | Towery | |
| 4,531,262 A | | 7/1985 | Reiche | |
| 4,940,367 A | | 7/1990 | Stäheli et al. | |
| 5,205,018 A | * | 4/1993 | Leifeld et al. | 19/145.5 |
| 5,218,741 A | | 6/1993 | Leifeld et al. | |
| 6,029,317 A | * | 2/2000 | Meile et al. | 19/145.5 |

FOREIGN PATENT DOCUMENTS

| | | | |
|---|---|---|---|
| CH | 550 956 | A | 5/1974 |
| DE | G 81 37 585.9 | U1 | 5/1985 |
| DE | 39 16986 | A1 | 11/1990 |
| DE | 40 22 681 | A1 | 1/1992 |
| DE | G 91 15 224.0 | U1 | 3/1992 |
| EP | 0 175 056 | A1 | 3/1986 |
| GB | 1036836 | B | 7/1966 |
| GB | 2 153 492 | A | 8/1985 |
| GB | 2153492 | A | 8/1985 |

OTHER PUBLICATIONS

British Search Report, dated Apr. 26, 2006, based on corresponding British Application No. GB0525042.8.
French Patent Office Preliminary Search Report, dated Apr. 18, 2007, issued for corresponding French Application No. 05 12657.

* cited by examiner

*Primary Examiner*—Shaun R Hurley
(74) *Attorney, Agent, or Firm*—Venable LLP; Robert Kinberg; Steven J. Schwarz

(57) ABSTRACT

In an apparatus in spinning preparation for feeding a plurality of charging shafts 2 to 6, especially a mixer 1, with fiber material that is transported for example pneumatically in a supply channel 8 and deflected into the charging shafts by means of deflecting devices, each charging shaft is closable at its upper end by means of a rotary gate 11 which, in its open position, closes off the cross-section of the supply channel. In order to increase the efficiency by means that are simple in terms of construction and, above all, to improve the transmission of the drive movement to the movement of the rotary gate 11, the rotary gate co-operates with a drive element 20; 21; 22; 23; 26 which imparts a rotary movement to the rotating axle of the rotary gate.

19 Claims, 2 Drawing Sheets

I-I

APPARATUS FOR FEEDING A PLURALITY OF CHARGING SHAFTS, ESPECIALLY A MIXER, WITH FIBRE MATERIAL

CROSS REFERENCE TO RELATED APPLICATION

This application claims priority from German Patent Application No. 10 2004 060 403.7 dated Dec. 14, 2004, the entire disclosure of which is incorporated herein by reference.

BACKGROUND OF THE INVENTION

The invention relates to an apparatus in spinning preparation for feeding a plurality of charging shafts, especially a mixer, with fibre material.

Fibre material may be transported, for example pneumatically, in a supply channel and deflected into the charging shafts by means of deflecting devices, each charging shaft being closable at its upper end by means of a rotary gate which, in its open position, closes off the cross-section of the supply channel. From a given batch of bales it is necessary to produce, in rationalised manner, a mixture in which optimum distribution of the starting material in respect of staple length, fineness, maturity degree, colour etc. is always ensured. The mixture not only forms the basis for producing yarns of consistently high quality in respect of uniformity, tear strength, dye take-up characteristics etc. but also improves the running properties of the material during subsequent processing. A multi-mixer, for example a Universal MX-U mixer, which can be constructed with 6, 8, 10 or 12 chambers, is used for the production of a homogeneous mixture of such a kind. The doubling number (flock doubling) corresponds to the number of chambers. Doubling results especially in the mixture being made more uniform, that is to say doubling is intended to equalise variations in the fibre material.

The hourly production rate and mixing quality are the fundamental performance features of a mixer. A method using a known mixer, the MPM mixer, has a production output of 600 kg/hour in the case of six chambers and of 1200 kg/hour in the case of twelve chambers so that a high hourly production rate is achieved. The quality of the mixture is crucially governed by how evenly flaws present in the supplied material are distributed in the quantity of fibre material. Crucial for the quality of the mixture and, therefore, the main function of the mixer altogether is the distribution of the flaws within as large a fibre quantity as possible, that is to say the equalisation of medium-duration and long-duration flaws in the composition of the supplied fibre material. The greater the quantity of fibre material in which the flaws that are present are to be uniformly distributed, the greater is the success of that equalisation and, therefore, the quality of the mixture. Short-duration flaws, that is to say flaws relating to small fibre material quantities, are already equalised in part on bale opening. Modern bale openers, for example the BLENDOMAT BO-A, already limit, as a result of their flock removal, the magnitude of flaws to very small levels from the outset.

In a known apparatus, a crank mechanism is associated with the rotary gate. The straight-slider crank has identical advance and return times, that is to say an idle time of 50%. A further disadvantage is that the connecting rod is subjected to bending stress. In addition, it is a problem that only a small amount of torque can be transmitted.

It is an aim of the invention to provide an apparatus of the kind mentioned at the beginning that avoids or mitigates the mentioned disadvantages and that especially increases the efficiency by means that are simple in terms of construction and, above all, improves transmission of the drive movement to the movement of the rotary gate.

SUMMARY OF THE INVENTION

The invention provides a fibre feed apparatus for use in a mixer, having a supply channel and a plurality of charging shafts, in which:

each charging shaft is provided at its upper end with a rotary gate which is movable between a closed position in which it closes the charging shaft and an open position in which it closes off the supply channel;

each rotary gate co-operates with a drive arrangement which imparts a rotary movement to an axle of the rotary gate.

As a result of the fact that power at the drive element is transmitted to the rotating axle of the rotary gate, the efficiency of the apparatus is considerably improved by means that are simple in terms of construction. Especially when a pneumatic mechanism (pressure cylinder) is used, the simple installation, high degree of operational reliability and high speed of operation (for example, up to 3 m/sec) are advantageous. As a result of the preferred use of a rack and pinion mechanism, the transmission of power at the pinion is characterised by low speeds of rotation and high torques. The combination of a pneumatic cylinder with a rack and pinion mechanism makes possible a turning cylinder wherein there are no dead centres in the end positions of the cylinder. The rotary gate drive according to the invention is simple in terms of construction and makes possible a high degree of efficiency in the transmission of movement.

Advantageously, the drive movement (drive element) is arranged to be transmitted to the rotating axle in the form of a rotary outgoing drive movement (outgoing drive element). Advantageously, a mechanism having a rectilinear incoming drive and a rotary outgoing drive is provided. Advantageously, the rectilinear incoming drive comprises a pressure cylinder, for example, a pneumatic cylinder. The cylinder may be a double-acting cylinder. The pressure cylinder may co-operate with a toothed rack. Advantageously, the outgoing drive element is a pinion, which meshes with the toothed rack. Advantageously, a mechanism having a rotary incoming drive and a rotary outgoing drive is provided. Advantageously, a gear wheel mechanism is provided. Advantageously, a traction mechanism is provided. Advantageously, the traction mechanism comprises a toothed belt and two toothed belt wheels. Advantageously, a frictional mechanism is provided. For example, at least one frictional wheel may be provided. Advantageously, a drive motor is associated with the drive element. Advantageously, the drive motor may be an electric motor, which can preferably be switched and/or reversed. Advantageously, the electric motor is a stepper motor.

Advantageously, the closure element of the rotary gate is made from continuously cast aluminium. Advantageously, the closure element is in the form of a continuously cast aluminium profile. Advantageously, the closure element has hollow spaces which pass through it in the longitudinal direction. Advantageously, the holding elements at the end faces are in the form of plates, discs or the like, for example aluminium. Advantageously, the rotary gate is rotatable about its longitudinal axis, preferably in two directions of rotation. Advantageously, the closure element of the rotary gate is approximately in the shape of a section of a cylinder. Advantageously, the rotary gate is rotatable through an angle of about 90° to 160°. Advantageously, with each rotary gate there is associated at least one mechanism having an incoming and outgoing drive. Advantageously, a turning cylinder is provided. Advantageously, the turning cylinder is directly mounted on the rotating axle. Advantageously, the turning cylinder comprises an integral valve. Advantageously, turning cylinder comprises a torque support. Advantageously, the outgoing drive element and the rotating axle of the rotary gate are arranged coaxially. Advantageously, the holding elements at the end faces are circular. Advantageously, the holding elements have seals on their outer peripheries. Advantageously, each charging shaft has an upper sensor, for example photocells, and a lower sensor, for example photocells, which are connected to an electronic control and regulation device. Advantageously, the drive elements for the rotary gates are connected to the electronic control and regulation device.

The invention also provides an apparatus in spinning preparation for feeding a plurality of charging shafts, especially a mixer, with fibre material that is transported for example pneumatically in a supply channel and deflected into the charging shafts by means of deflecting devices, each charging shaft being closable at its upper end by means of a rotary gate which, in its open position, closes off the cross-section of the supply channel, wherein the rotary gate co-operates with a drive element which imparts a rotary movement to the rotating axle of the rotary gate.

DETAILED DESCRIPTION OF PREFERRED EMBODIMENTS

Figure 1:
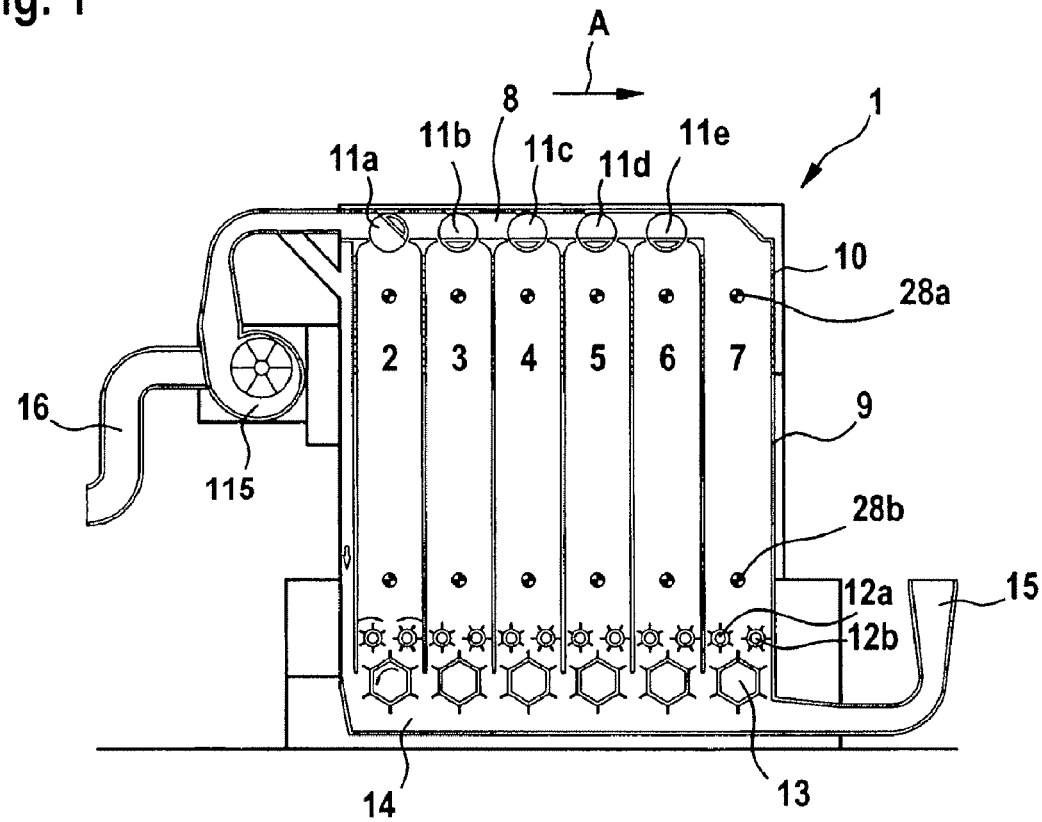
FIG. 1 shows a mixer together with an apparatus according to the invention.

With reference to FIG. 1, shows a mixer 1 (for example a Universal Mixer MX-U made by Trützschler GmbH & Co. KG of Mönchengladbach, Germany), has six charging shafts (chambers) 2 to 7, which are connected in a series one after the other to a channel 8, through which the fibres are conveyed by air in the direction of the arrow A. In the region of their upper ends, the chamber walls 9 have air outlet apertures 10. Each of the charging shafts 2 to 6 is closable at its upper end by means of a rotary gate 11*a* to 11*e*, which in its open position—as is shown for shaft 2—closes off the remaining portion of the channel 8. In the region of the lower end of each charging shaft 2 to 7 there are arranged two take-off rollers 12*a*, 12*b* and one opener roller 13 in each case. Below the charging shafts 2 to 7 there is arranged a common mixing channel 14, from where the fibre flocks deposited therein are conveyed towards a suction offtake funnel 115, which is connected to a condenser (not shown). From the bale opener arranged downstream (that is to say in the direction opposite the material flow) the fibre material is drawn off under suction by a material-transporting fan 15 by way of a pipeline 16 and is conveyed into the channel 8 above the chambers 2 to 7. By means of the pneumatic conveying apparatus (pipeline 16, fan 15, channel 8), the fibre material is filled into successive charging shafts 2 to 7 of the mixer 1.

Figure 2:
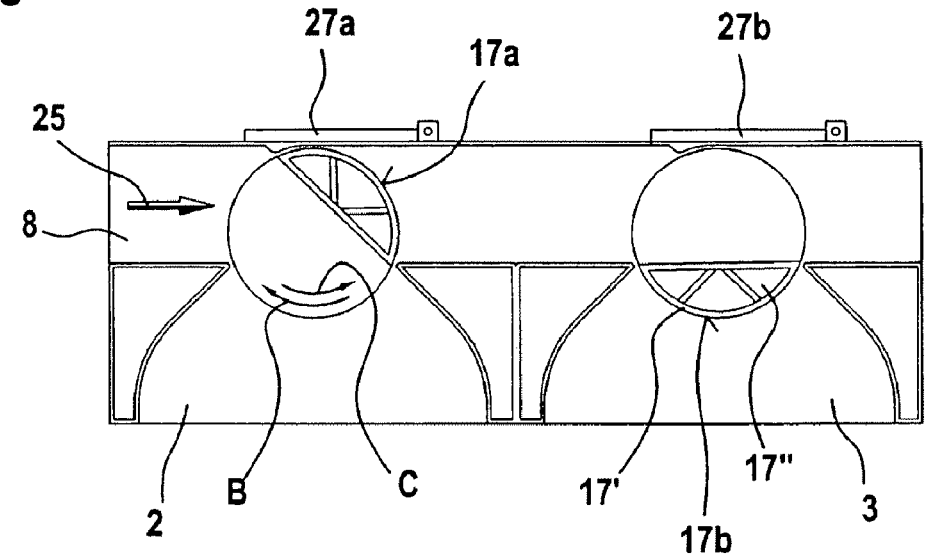
FIG. 2 is a side view of the supply channel and the upper region of two connected charging shafts, one rotary gate being in the closed position and one rotary gate being in the open position.

Referring to FIG. 2, the rotary gate 11*a* is provided above the charging shaft 2; the closure element 17*a* is in the open position, that is to say the upper opening of the charging shaft 2 is open and the cross-section of the channel 8 is closed off. The fibre/air mixture shown by the half-filled-in arrow 25 is deflected from the channel 8 into the charging shaft 2 by the closure element 17*a*. The rotary gate 11*b* is provided above the charging shaft 3; the closure element 17*b* is in the closed position, that is to say the upper opening of the charging shaft 3 is closed off and the cross-section of the channel 8 is open or, that is to say, free. The rotary gates 11*a* to 11*e* can be rotated about their longitudinal axes 26 (see FIG. 3*b*) in the direction of arrows B and C. On rotation in direction B the charging shafts 2 to 6 are opened and the channel 8 is closed off, and on rotation in direction C the charging shafts 2 to 6 are closed off and the channel 8 is opened. The obtuse angle of the impact surface of the closure element 17*a* with respect to the horizontal is, for example, 135°.

The closure element 17 is an extruded aluminium profile having web plates 17' and hollow spaces 17" that pass through it. The closure element 17 has a cross-section substantially in the shape of a section of a cylinder. The two end faces of the closure element 17 are each attached to a circular holding element 18*a*, 18*b*, for example an aluminium disc. Reference numerals 27*a*, 27*b* denote pivoting hatches which are closed in operation and which can be opened, for example, for inspection or the like.

Figure 3A:
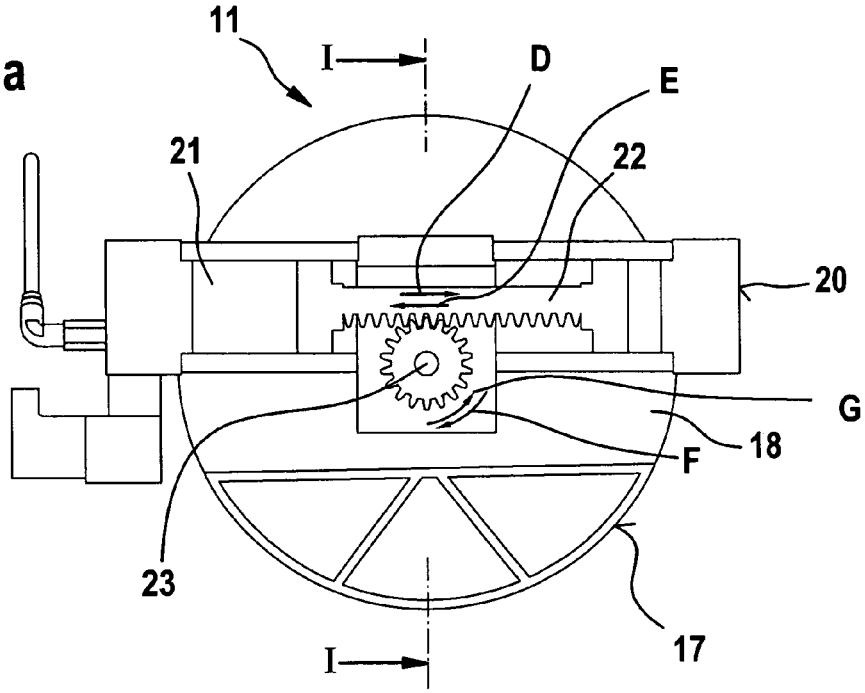
FIGS. 3*a*, 3*b* are a side view (FIG. 3*a*) and a sectional front view (FIG. 3*b*) of a rotary gate according to the invention driven by means of a turning cylinder.
Figure 3B:
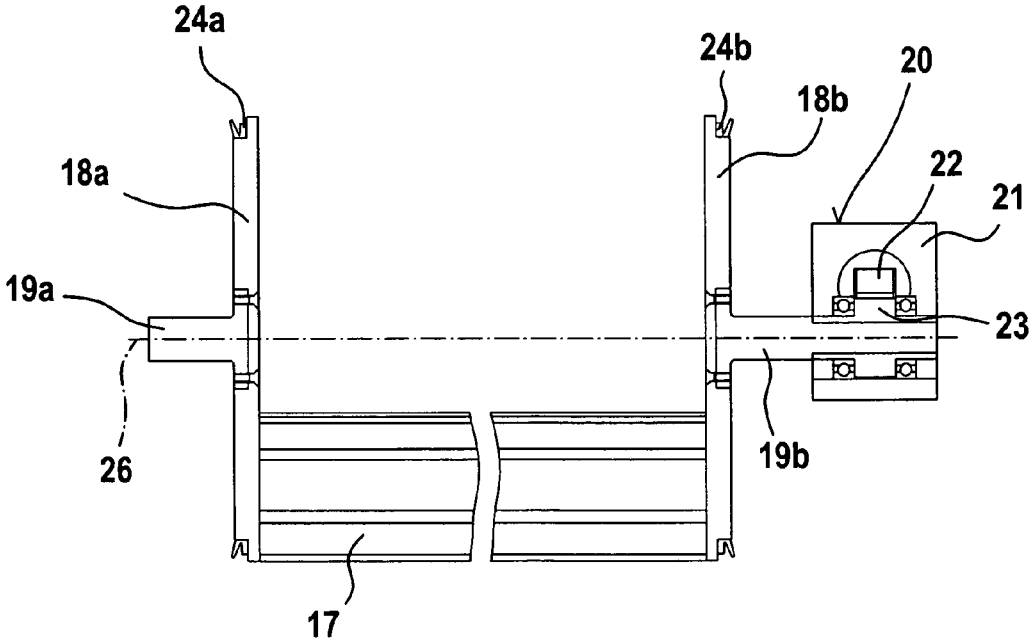

In accordance with FIGS. 3*a*, 3*b*, each rotary gate 11 comprises a closure element 17 having two holding elements 18*a*, 18*b* and a mechanism 20. The laterally arranged mechanism 20 comprises an incoming drive in the form of a double-acting pneumatic cylinder 21, wherein a toothed rack 22 can be moved in the direction of arrows D, E. The mechanism 20 comprises an outgoing drive in the form of a pinion 23, which is rotatable in the direction of arrows G, F and which co-operates with the toothed rack 22 in a meshing (positive) connection. Attached at the centres of the circular holding discs 18*a*, 18*b* are mounting axles 19*a* and 19*b*, respectively. The pinion 23 is fixed on the mounting axle 19*b* concentrically. Seals 24*a* and 24*b* are provided on the outside edges of the holding discs 18*a* and 18*b*, respectively.

The arrangement according to FIGS. 3*a*, 3*b* provides a mechanism having a rectilinear incoming drive and a rotary outgoing drive. A turning cylinder drive is provided which imparts rotary movement B, C directly to the rotating axle 26 of the rotary gate 11.

In accordance with FIG. 1, the charging shafts 2 to 7 each have an upper photocell 28*a* and a lower photocell 28*b*, which serve to ascertain the fill level of fibre material and which are connected to an electronic control and regulation device (not shown). The electronic control and regulation device is further connected to the electro-pneumatic pressure cylinders 20, which are associated with each rotary gate 11.

Although the foregoing invention has been described in detail by way of illustration and example for purposes of understanding, it will be obvious that changes and modifications may be practised within the scope of the appended claims.

What is claimed is:

1. A fibre feed apparatus for use in a mixer, having a supply channel and a plurality of charging shafts, in which:

each charging shaft is provided at its upper end with a rotary gate which is movable between a closed position in which it closes the charging shaft and an open position in which it closes off the supply channel;

each rotary gate co-operates with a drive arrangement which imparts a rotary movement to an axle of the rotary gate;

each charging shaft has an upper sensor and a lower sensor for detecting fibre material in the respective charging shaft, which sensors are connected to an electronic control and regulation device; and the drive arrangements for the rotary gates are connected to the electronic control and regulation device.

2. A feed apparatus according to claim 1, in which the drive arrangement comprises a rectilinear incoming drive and a rotary outgoing drive.

3. A feed apparatus according to claim 2, in which the rectilinear incoming drive is a toothed rack and the outgoing drive element is a pinion, which meshes with the toothed rack.

4. A feed apparatus according to claim 2, in which the rectilinear incoming drive comprises a pressure cylinder.

5. A feed apparatus according to claim 1, in which a mechanism having a rotary incoming drive and a rotary outgoing drive is provided.

6. A feed apparatus according to claim 1, in which the drive arrangement includes one or more of a gear wheel mechanism, a traction mechanism, and a frictional mechanism.

7. A feed apparatus according to claim 1, in which the drive arrangement includes a drive motor.

8. A feed apparatus according to claim 7, in which the drive motor is an electric motor which can be switched and/or reversed.

9. A feed apparatus according to claim 8, in which the electric motor is a stepper motor.

10. A feed apparatus according to claim 1, in which the rotary gate has a closure element comprising an extruded aluminium profile.

11. A feed apparatus according to claim 10, in which the closure element has hollow spaces which extend through it in the longitudinal direction.

12. A feed apparatus according to claim 1, in which the rotary gate comprises at its end faces holding elements in the form of plates on discus.

13. A feed apparatus according to claim 12, in which the holding elements have seals on their outer peripheries.

14. A feed apparatus according to claim 1, in which the rotary gate is rotatable about its longitudinal axis in two directions of rotation.

15. A feed apparatus according to claim 1, in which the rotary gate is rotatable through an angle of about 90° to 160°.

16. A feed apparatus according to claim 1, in which with each rotary gate there is associated at least one mechanism having an incoming and outgoing drive.

17. A feed apparatus according to claim 1, in which the drive element comprises a turning cylinder which may be directly mounted on the rotating axle.

18. A feed apparatus according to claim 1, in which the drive arrangement comprises an outgoing drive element which is arranged coaxially with a rotating axle of the rotary gate.

19. A feed apparatus for feeding fibre material in a fibre mixer, comprising a supply channel and a plurality of charging shafts an upper end of each of which is in communication with the supply channels, wherein there is provided a rotary closure member for selectively closing the upper end of each shaft or the supply channel, and a drive arrangement for the rotary closure member, the drive arrangement being arranged to impart a rotary movement to an axle of the rotary closure member, wherein each charging shaft has an upper sensor and a lower sensor for detecting fibre material in the respective charging shaft, which sensors are connected to an electronic control and regulation device, and the drive arrangements for the rotary gates are connected to the electronic control and regulation device.

* * * * *